United States Patent [19]

Koenig et al.

[11] 4,305,732

[45] Dec. 15, 1981

[54] GASIFICATION APPARATUS WITH PRESSURE RELIEVING MEANS

[75] Inventors: Dieter Koenig; Klaus-Otto Kuhlbrodt; Klaus Lucas; Peter Goehler, all of Freiberg; Friedrich Berger, Brand-Erbisdorf; Manfred Schingnitz, Freiberg, all of German Democratic Rep.; Aleksander Jegorow, Moskwa, U.S.S.R.; Vasilij Fedotov, Moskwa, U.S.S.R.; Vladimir Gavrilin, Moskwa, U.S.S.R.; Ernest Gudymov, Moskwa, U.S.S.R.; Vladimir Semenov, Moskwa, U.S.S.R.; Igol Achmatov, Moskwa, U.S.S.R.; Nikolaj Madjurov, Moskovsk, U.S.S.R.; Evgenij Avraamov, Moskwa, U.S.S.R.

[73] Assignees: Brennstoffinstitut Freiberg, Freiberg, German Democratic Rep.; Gosudarstwennyi Nautschno-Issledowatelskij I Projektnyi Institut Asotnoj Promischlennosti I Produktow Organitscheskogo Sintesa, Moskau, U.S.S.R.

[21] Appl. No.: 122,685

[22] Filed: Feb. 19, 1980

[51] Int. Cl.[3] ..... C10J 3/48

[52] U.S. Cl. ..... 48/67; 122/5; 122/6 A; 422/202; 422/203

[58] Field of Search ..... 48/67, 68; 422/202, 422/203, 241; 122/5, 6 A, 233, 234

[56] References Cited

U.S. PATENT DOCUMENTS 1,023,567 4/1912 Huttinger ..... 48/67

2,832,678 4/1958 Ackeren ..... 48/67

*Primary Examiner*—Peter F. Kratz

*Attorney, Agent, or Firm*—Michael J. Striker

[57] ABSTRACT

The reactor for producing gas from powdery fuels comprises an outer metal sheet jacket, an inner pressure resistant jacket defining with the outer jacekt a first interspace for a cooling liquid, reinforcing brick lining adjoining the inner wall of the inner jacket, a cooling shield enclosing a reaction chamber and defining with the brick lining a second interspace for an inert cooling fluid. The cooling shield has at its upper end a gap communicating with the second interspace and the lower end of the reactor is provided with a pressure releasing conduit communicating with the bottom of the second interspace so that when the gas generating process is interrupted and the conduit is opened the pressurized gas escapes from the reactor chamber through the upper gap and flows through the major part of the second interspace to be cooled down before the discharge from the connecting conduit.

5 Claims, 2 Drawing Figures

GASIFICATION APPARATUS WITH PRESSURE RELIEVING MEANS

BACKGROUND OF THE INVENTION

The invention relates generally to reactors for producing gas from powdery fuels and more particularly it relates to a device for relieving pressure from such a reactor. The reactor is of the type in which a powdery fuel is gasified under pressure whereby hydrogen and carbon-monoxide containing gases are produced which directly or after an initial processing are employed as heating gas, synthetic gas, reduction gas, mixing complements for other gases such as for example coal gas and the like. As a powdery fuel in this type of reactor is usually used finely divided brown coal and/or stone coal as well as finely crushed carbon containing solid residuals of a coal refining process as well as of a crude oil refining process or solid carbon containing organic material of other origin (such as, for example, lumber waste, used tires, plastic wastes and the like) also finely divided in the form of dust.

In view of the wide variety of applicable powdery fuels, a particularly advantageous method of gasification of such finely divided fuel materials has proved to be a flame reaction between the powdery fuel and oxygen containing oxidation agent. In carrying out such a known technology at which the gas is produced at an increased pressure, there result however problems how to discharge hot-pressurized gases from the reactor when the latter discontinues its operation or in the case of emergency. The produced hot gases are namely under pressure between 20 to 50 bars, and to handle such pressures requires additional technical measures. It has been devised to conduct the hot high-pressure gases through the discharge opening from the reactor which is normally arranged at the bottom of the latter and serves for discharging both the crude gas and the liquid slag, and in the range of discharge opening to cool the gases by a spray of water, or by introducing the gases in a gas purifying apparatus. The suggested solution, however, has several disadvantages. As the first disadvantage occurs in the case of feeding failure of the powdery fuel through the burner inasmuch before the feeding of the oxygen is shut off a certain amount of the oxygen reaches the reaction chamber and during the discharge of gases through a common discharge port the oxygen containing gas enters the subsequent processing units of the gas producing plant and may endanger the latter. The second disadvantage of this prior art solution occurs when the common discharge port for the crude gas and the slag becomes blocked by slag deposits and by refractory material coming loose from the lining of reactor so that the pressure relief of the gas in the devised passage is no longer possible.

A device is also known in which a connecting piece is arranged in the burner instert opening into the reaction chamber or in the upper part of the reactor whereby an interlocking mechanism with a subsequently connected quenching circuit is attached to this connecting piece. The disadvantage of this device resides in the necessity of maintaining continuous rinsing of the interlocking mechanism by an inert gas in order to insure a proper function of this mechanism during the operation of the reactor. As a result the operational cost increases due the applied auxiliary cooling medium such as nitrogen, for example, and the quality of the produced gases especially as regards their heating value decreases. Another disadvantage of this solution results from the fact that at certain operational conditions in the reactor the discharge opening becomes clogged due to the incrustation of slag and due to the slag deposition and the operability and the proper functioning of the reactor is impaired. A third disadvantage results also from the fact that the additional interlocking mechanism including the connecting piece has to be additionally cooled by means of a cooling liquid in order to insure the operability of the reactor at high temperatures. Accordingly an increased consumption of cooling water and of energy for supplying the latter to the reactor will result.

SUMMARY OF THE INVENTION

It is, therefore, a general object of the present invention to overcome the aforementioned disadvantages.

More particularly, it is an object of the invention to provide an improved reactor of the aforedescribed type in which the release of hot gases from the reaction chamber can be reliably made without the danger that solidified slag might impair the pressure releasing process.

Another object of this invention is to provide a pressure releasing device in the reactors of the aforedescribed type which operates without additional expenditures of cooling inert gas and without additional cooling water.

Still another object of this invention is to provide such an improved reactor which operates without the injection of a water spray into the range of the discharge opening.

Still another object of this invention is to provide such an improved reactor which is capable of producing gases from a dusty fuel material under increased pressure preferably under pressures between 5 and 50 bars whereby in the event of the interruption of the gas generating process or in the case of failure of the reactor the gas can be continuously relieved without endangering or impairing the reactor itself or the subsequent processing stages of the gas-producing plant.

Furthermore, an additional object of this invention is to provide such an improved reactor which can operate with a minimum consumption of cooling inert gases, cooling fluids and with a minimum consumption of energy.

In keeping with these objects and others which will become apparent hereafter, one feature of the invention resides, in a reactor for producing gas from powdery fuels in the provision of a cooling shield which encloses the entire reaction chamber except the points where the burner or the discharge opening for the produced crude gas and liquid slag take place. The cooling shield includes conduits for the stream of cooling water under increased pressure. Radially spaced from the cooling shield is arranged a brick lining the inner wall of which defines with the shield an interspace and the outer wall of the lining adjoins a pressure resistant inner jacket which again is spaced from an outermost metal sheet jacket whereby the interspace between the inner and outer jacket serves for receiving a cooling medium preferably a cooling water. The reaction chamber and the interspace behind the cooling shield are connected through a gap in the shield. The gap is located in the upper part of the reactor preferably at the transition line between the cylindrical upright wall of the shield and its arched end portion. The connecting piece or conduit passes through the outer jacket, the first interspace for the cooling water, the inner jacket and the brick lining and opens into the second interspace adjoining the cooling shield in the region remote from the aforementioned gap, preferably at the bottom part of the reactor. This second interspace during the operation of the reactor is rinsed by an inert gas preferably by nitrogen. According to this invention, hot gases generated in the reaction chamber under high pressure is discharged through this connecting conduit in such a manner that gas flows from the reaction chamber through the gap in the cooling shield and returns along the outer wall of the shield through the major portion of the second interspace so that the outer wall of the shield and the inner wall of the brick lining which are relatively cool with respect to the discharged gases, reduce the temperature of the latter so that a danger free pressure relief is made possible.

According to another feature of this invention a quenching pipe for an indirect cooling is connected downstream of the connecting conduits so as to accelerate the pressure releasing process.

In another embodiment of this invention the inert fluid for cooling the second interspace is introduced into the latter through the same connecting piece through which the pressure release takes place. In this case the outwardly projecting part of the connecting piece is branched so that one branch leads to the source of the inert cooling fluid and the other branch is used for the pressure release.

The novel features which are considered as characteristic for the invention are set forth in particular in the appended claims. The invention itself, however, both as to its construction and its method of operation, together with additional objects and advantages thereof will be best understood from the following description of specific embodiments when read in connection with the accompanying drawing.

DESCRIPTION OF THE PREFERRED EMBODIMENTS

Figure 1:
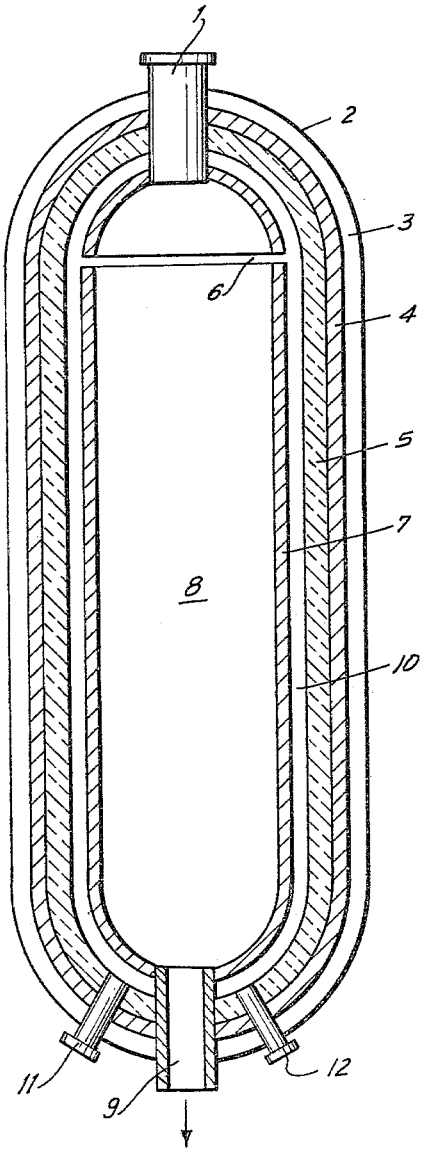
FIG. 1 is an axial cross-section of the reactor of this invention.

Referring firstly to FIG. 1, the reactor for producing gases by combusting powdery solid fuels includes an outer metal sheet jacket 2 of an upright cylindrical configuration with arched ends, and inner jacket 4 of a pressure resistant material. The first interspace between the inner and outer jackets serves for circulation of cooling water 3. The inner wall of the inner jacket is reinforced by a brick lining 5 and spaced apart from the inner wall of the lining is arranged the cooling shield 7 which encloses the reaction chamber 8 and is provided at its upper end portion with a gap 6 which connects the reaction chamber with the second interspace 10 between the shield and the inner wall of the brick lining. The burner insert 1 passes through the vaulted upper end of the reactor through the jacket 2, the water jacket 3, the metal sheet jacket 4 and the brick lining 5 and the cooling shield 7 and opens into the reaction chamber 8. At the lower vault of the reactor, a discharge opening 9 for discharging both the produced gases and the liquid slag connects the reaction chamber 8 with the exterior. In the vicinity of the discharging port 9 there is provided a connecting conduit 11 for an inert gas which opens into the second interspace between the shield 7 and the inner wall of the lining 5. According to this invention, a separate connecting conduit 12 which is normally closed during the operation of the reactor opens into the second interspace 10 at the bottom portion of the reactor.

The pressure release of the reactor as illustrated in FIG. 1 takes place in the following manner. Upon opening the separate pressure releasing conduit 12 the hot gases generated under pressure in the reaction chamber 8 enter through gap 6 in the upper end of the reaction chamber into the second interspace 10 and flow along the walls of the cooling shield 7 and the lining 5 toward the pressure releasing conduit 12. During the flow in the interspace 10, the hot gases are cooled by the shield 7 and the lining 5 and consequently a safe discharge of the gases through the conduit 12 is made possible.

Figure 2:
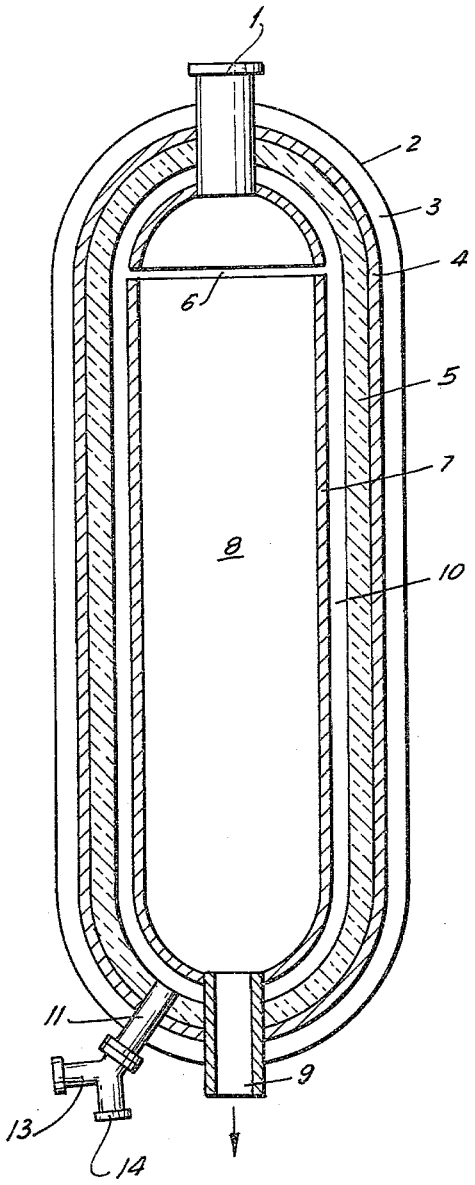
FIG. 2 is a modification of the reactor of FIG. 1.

In the modification according to FIG. 2, the overall arrangement of the reactor is similar to the embodiment of FIG. 1 except the connecting conduit 11 for the inert gas is employed both for the introduction of the inert gas into the second interspace 10 and for the discharge of the generated hot gases. For this purpose, the outer end of the connecting piece 11 is branched into a branch 13 for the inert gas and a branch 14 for discharging the hot gases from the reactor.

During the depressurizing operation in the embodiment of FIG. 2, the branch 13 for the inert gas is closed and the normally closed branch 14 for the pressure release is opened. Subsequently, gases from the reaction chamber 8 escape through the gap 6 into the interspace 10 and through the branch 14 in the same manner as in the preceding example.

It will be understood that each of the elements described above, or two or more together, may also find a useful application in other types of constructions differing from the type described above.

While the invention has been illustrated and described as embodied in specific examples of the pressure releasing device for gas generating reactors, it is not intended to be limited to the details shown, since various modifications and structural changes may be made without departing in any way from the spirit of the present invention.

What is claimed as new and desired to be protected by Letters Patent is set forth in the appended claims:

1. An upright reactor for producing gas from powdery fuels, comprising an outer jacket; an inner jacket defining with the outer jacket a first interspace for a cooling liquid; a reinforcing lining adjoining the inner wall of said inner jacket; a cooling shield enclosing a reaction chamber and defining with said lining a second interspace for an inert gas; a gap formed in said shield to establish a communication between said second interspace and said reaction chamber, said first interspace being in non-communicating relationship with said reaction chamber and said second interspace; a burner insert communicating with the upper end of said reaction chamber; a discharge conduit means communicating with the lower part of said reaction chamber to discharge produced gases and liquid slag, said burner insert and said discharge conduit means passing, respectively, through the outer jacket, the inner jacket, the reinforcing lining and the cooling shield; and at least one outer connecting conduit communicating with said second interspace at a point remote from said gap including means to feed inert gas to said second interspace and, when the gas generating process as interrupted, means to release pressurized gases from said reaction chamber via the gap and a major part of said second interspace.

2. The reactor as defined in claim 1 wherein said jackets and said shield have an upright cylindrical wall closed by arched end portions, said gap being formed in said shield between the transition line of said cylindrical wall and the upper end portion, and said outer connecting conduit communicating with said second interspace in the lower end portion of said reactor.

3. The reactor as defined in claim 1 wherein said outer connecting conduit has a branch for introducing said inert gas into said second interspace and a normally closed second branch for discharging the pressure gases from said reaction chamber.

4. An upright cylindrical reactor for producing pressurized gas from powdery fuels, comprising an outer jacket; an inner jacket defining with the outer jacket a first interspace for a cooling liquid; a reinforcing lining adjoining the inner wall of said inner jacket; a cooling shield enclosing a reaction chamber and defining with said lining a second interspace for an inert cooling fluid; a gap formed in said shield to establish a communication between said second interspace and said reaction chamber, said first interspace being in non-communicating relationship with said reaction chamber and said second interspace; an outer connecting conduit for applying inert gas to said second interspace; a burner insert communicating with the reaction chamber by passing through the upper end of the reactor through the outer jacket, the inner jacket, the reinforcing lining and the cooling shield and opening into the reaction chamber; a discharge opening means located at the lower end of the reaction chamber passing through the cooling shield, the reinforcing lining, the inner jacket and the outer jacket for discharging produced gases and liquid slag; and another outer connecting conduit communicating with said second interspace at a point remote from said gap to release in the event of an interruption of the gas generating process the pressurized gas flowing from said reaction chamber via the gap and a major part of said second interspace.

5. The reactor as defined in claim 4 wherein the connecting conduit for introducing said inert gas into said second interspace is spaced apart from said other connecting conduit.

* * * * *